United States Patent [19]

Ohata

[11] 4,098,245

[45] Jul. 4, 1978

[54] APPARATUS FOR CONTROLLING THE IGNITION TIMING OF AN INTERNAL COMBUSTION ENGINE

[75] Inventor: Akira Ohata, Susono, Japan

[73] Assignee: Toyota Jidosha Kogyo Kabushiki Kaisha, Toyota, Japan

[21] Appl. No.: 695,447

[22] Filed: Jun. 14, 1976

[30] Foreign Application Priority Data

Mar. 16, 1976 [JP] Japan ..... 51-30619[U]

[51] Int. Cl.[2] ..... F02P 5/02

[52] U.S. Cl. ..... 123/117 A; 91/183; 92/48; 92/64

[58] Field of Search ..... 123/117 A, 117 R, 146.5 A; 92/48, 63, 64; 91/170 R, 183

[56] References Cited

U.S. PATENT DOCUMENTS

| | | | |
|---|---|---|---|
| 3,013,537 | 12/1961 | Schultz | 92/48 X |
| 3,515,105 | 6/1970 | Soeters | 123/117 A |
| 3,521,609 | 7/1970 | Kashiwagi et al. | 123/117 A |
| 3,638,626 | 2/1972 | Marshall | 123/117 A |
| 3,800,758 | 4/1974 | Sutherland | 123/117 A |
| 3,915,132 | 10/1975 | Thornburgh | 123/117 A |

*Primary Examiner*—Charles J. Myhre
*Assistant Examiner*—Tony M. Argenbright
*Attorney, Agent, or Firm*—Stevens, Davis, Miller & Mosher

[57] ABSTRACT

Apparatus for controlling the ignition timing of an internal combustion engine provided with an exhaust gas recirculation system. A vacuum advancer has a diaphragm mechanism to control the vacuum ignition timing in response to negative pressure in the carbureter when a part of the exhaust gas is recirculated from the exhaust manifold to the intake manifold. A vacuum transmitting valve restricts the transmission of negative pressure in the carbureter to the vacuum advancer, whereby vacuum ignition timing advance of the engine during acceleration is delayed.

1 Claim, 1 Drawing Figure

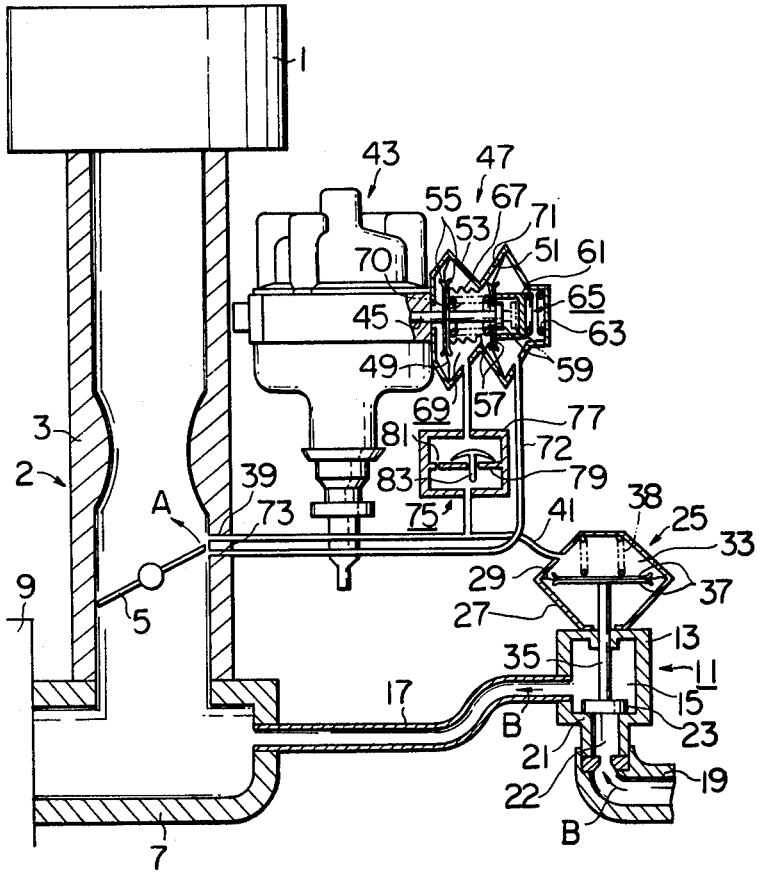
1
43
47
55
67
53
71
51
61
70
65
45
63
49
59
69
57
77
81
72
3
2
39
83
79
A
73
75
41
38
25
33
9
29
37
5
27
13
35
11
17
15
B
23
21
19
22
B
7

APPARATUS FOR CONTROLLING THE IGNITION TIMING OF AN INTERNAL COMBUSTION ENGINE

FIELD OF THE INVENTION

The present invention relates to apparatus for controlling the ignition timing of an internal combustion engine provided with an exhaust gas recirculation system (EGR System).

BACKGROUND OF THE INVENTION

It is well known that exhaust gas recirculating (EGR) operation in an internal combustion engine, to decrease the amount of nitrogen oxides ($NO_x$) in the engine exhaust, causes inferior flame propagation velocity in the combustion chamber of the engine. Therefore, it is necessary to advance the ignition timing during EGR operation to obtain maximum output power and maximum fuel consumption efficiency.

To this end it is already known to provide such apparatus with a vacuum advancer having a diaphragm mechanism to control the vacuum ignition timing in response to the negative pressure in the carbureter when the EGR is in operation.

However, this type of apparatus has the disadvantage that vacuum ignition timing during engine acceleration is advanced, when there is no necessity for it. To advance the ignition timing during acceleration causes substantially increased amounts of $NO_x$ in the exhaust.

SUMMARY OF THE INVENTION

An object of the present invention is to provide apparatus for controlling the ignition timing of an internal combustion engine provided with an EGR system, so that ignition timing advance during engine acceleration is delayed.

Another object of the present invention is to provide apparatus which allows the amount of $NO_x$ in the exhaust to be decreased.

According to the improvement of the present invention the apparatus comprises means for transmitting the negative pressure in the carbureter to the vacuum advancer after a certain period has elapsed from the beginning of an engine accelerating operation. As a result of this, vacuum ignition timing advance of the engine during acceleration is delayed.

BRIEF DESCRIPTION OF THE DRAWING

The accompanying drawing shows a diagramtic view of apparatus for controlling the ignition timing of the internal combustion engine according to the invention.

DETAILED DESCRIPTION OF THE PREFERRED EMBODIMENT

Referring to the drawing, an internal combustion engine according to the invention has an air cleaner 1 which is connected to a carbureter 2 which has a venturi 3 and a throttle valve 5 located downstream from the venturi 3. The carbureter 2 is connected, through intake manifold 7, to the engine body 9 to supply an air-fuel mixture to combustion chamber (not shown) formed in the engine body 9.

The engine is provided with an exhaust gas recirculation system having a exhaust gas recirculation valve (EGR valve) 11. The EGR valve 11 includes a body 13 which provides a chamber 15 therein which is connected, through a pipe 17, to the intake manifold 7, and which is connected, through another pipe 19, to the exhaust manifold (not shown) of the engine so as to recirculate a part of the exhaust gas from the exhaust manifold to the intake manifold 7. A valve seat 21 defines a passage 22 which connects the pipes 17 and 19 through the chamber 15. The passage 22 is opened or closed by a valve member 23 which is operated by a diaphragm mechanism 25 of the EGR valve 11. The diaphragm mechanism 25 has a casing 27 which is fixed to the body 13, and a diaphragm 29 which is arranged acron the inferior of the casing 27 so as to form a vacuum chamber 33 on the side remote from the EGR valve 11. The diaphragm 29 is mechanically connected to the valve member 23 by a rod 35. The upper end of the rod 35 is connected to the diaphragm 31 by a pair of plates 37 and the lower end of the rod 35 is integrally formed with the valve member 23. A coil spring 38 which is arranged in the vacuum chamber 33 of the diaphragm mechanism 25 urges the diaphragm 29 downwardly so that the valve member 23 closes against the valve seat 21. The vacuum chamber 33 communicates with a port 39 in the carbureter 2 by way of a tube 41 to transmit negative pressure in the carbureter 2 to the vacuum chamber 33. The port 39 is located upstream from the throttle valve 5 which is shown in its closed position in the drawing.

The apparatus for controlling the ignition timing of the internal combustion engine has a distributor 43 including a advance shaft 45 to control the vacuum ignition timing of the spark plugs (not shown), and a vacuum advancer 47 to move the advance shaft 45 in response to negative pressure in the carbureter 2. The vacuum advancer 47 is formed as a double diaphragm mechanism having two diaphragms 49 and 51 which are arranged across a casing 53 of the vacuum advancer 47, which is secured to the distributor 43. The diaphragm 49 is secured to the shaft 45 remote from the free end thereof by a pair of plates 55. The other diaphragm 51 is sandwiched between a pair of plates 57, having holes through which the advance shaft 45 freely passes. A flange portion 59 is formed on the free end of the shaft 45. A cup member 61 which covers the flange portion 59 is carried by the one of diaphragm plates 57. A spring 63 is arranged in a first chamber 5 which is formed in the casing 53 between the diaphragm 51 and the end of the casing 53, the spring acting between the end of the casing and cup member 61. The spring 63 urges the cup member 61, and hence the diaphragm 51, towards the distributor. A bellows member 67 is arranged between the inner surface of the casing 53 and the surface of one of the plates 55, so as to form a second chamber 69 between the bellows member 67 and diaphragm 49. Another spring 70 is arranged between the plates 55 and the plates 57. A vent hole 71 is formed in the casing 53 to prevent interference between the chamber 65, 69.

The first chamber 65 of the vacuum advancer 47 is connected, through a tube 72, to a second port 73 in the carbureter 2 which is located downstream from the throttle valve 5 when it is in its closed portion as shown in the drawing. The second chamber 69 of the vacuum advancer 47 is connected to the tube 41 through a vacuum transmitting valve device 75 which comprises a body 77 having a valve plate 79 therein. The valve plate 79 has a small orifice 81 to transmit negative pressure from the port 39 to the second chamber 69 at a controlled rate. The valve plate further has a check valve 83 to transmit atmospheric pressure in the carbureter 2 to the second chamber 69 of the vacuum advancer 47.

The apparatus for controlling the ignition timing of the internal combustion operates as follows.

When the engine is idling, the throttle valve 5 is closed in the position shown in the drawing. Because the port 73 is located downstream from the throttle valve 5, negative pressure which is formed in the carbureter 2 downstream from the throttle valve 5 is transmitted from the port 73 to the first chamber 65 of the vacuum advancer 47 through the tube 72. In this situation the second chamber 69 is at atmospheric pressure which is transmitted from the air cleaner 1, by way of the port 39, which is located upstream from the throttle valve 39, and the check valve 83 of the vacuum transmitting valve device 75. The diaphragm 51 is displaced toward the end of the casing 53 away from the distributor by the negative pressure from the port 73. In the displacement of the diaphragm 51 the vacuum advance shaft 45 is also displaced in the same direction, because the holes in the plates 57 secured to the diaphragm 51 and smaller than the flange portion 59 of the shaft 45. Thus the distributor 43 advances the ignition timing of the engine to obtain the required ignition timing of the engine in the idling condition.

In this idling condition atmospheric pressure is also transmitted to the chamber 33 of the EGR valve 11 through the port 39 and the tube 41, so that the EGR valve 11 remains closed. Therefore exhaust gas recirculation is not carried out to stabilize engine idling operation.

When the throttle valve 5 is opened in the direction shown by an arrow A to start accelerating from the idling condition, the EGR port 39 is exposed to the downstream side of the opened throttle valve 5, so that negative pressure in the carbureter 2 appears at the port 39. The negative pressure at the port 39 is transmitted to the chamber 33 of the EGR valve 11 through the tube 41 to displace the diaphragm 29 upwardly against the spring 38 and allow the valve member 23 to lift from the valve seat 21. As a result of this a part of the exhaust gas from the exhaust manifold is recirculated, through the pipes 19 and 17, into the intake manifold 7 as shown by arrows B to decrease the amount of nitrogen oxides ($NO_x$) in the exhaust gas.

The negative pressure at the port 39, however, is not fully transmitted to the vacuum advancer 47, at the beginning of the accelerating operation, because of the restricting orifice 81 located between the port 39 and the second chamber 69 of the vacuum advancer 47. Therefore, the vacuum ignition timing on initial acceleration is not advanced in comparison with the vacuum ignition timing in the idling condition. Therefore, increase in the amount of $NO_x$ on acceleration is prevented.

When a certain period, has elapsed from the beginning of the acceleration, as determined inter alia by the dimensions of the orifice 81, the negative pressure from the port 39 overcomes the spring 70 in the second chamber 69 through the orifice 81 and displaces the diaphragm 49 towards the end of the casing 53 away from the distributor against the spring 70, so that the flange portion 59 of the advance shaft 45 moves further towards the end of the casing 53 within the cup member 61, as shown by phantom lines. This displacement of the diaphragm 49 does not cause any movement of the first diaphragm 51 which is already displaced by the negative pressure at the port 73. As a result of this the ignition timing of the engine at constant load operation is further advanced in comparison with the ignition timing in the idling condition in accordance with the sum of the negative pressures at the ports 39 and 73, to obtain the required ignition timing during constant load operation in the exhaust gas recirculating condition.

While the invention has been described by reference to a specific embodiment for purposes of illustration, it should be apparent that numerous changes could be made within the spirit and scope of the invention.

What is claimed is:

1. An internal combustion engine comprising:

an air cleaner;

a carburetor which includes a throttle valve connected to said air cleaner;

an intake manifold located downstream of said carburetor;

an engine body connected to said intake manifold;

an exahust manifold for receiving the exhaust gas from the engine body;

a conduit connecting said exhaust manifold with said intake manifold;

a valve in said conduit for controlling the exhaust gas recirculation from said exhaust manifold to said intake manifold;

a first pipe connecting said exhuast gas recirculation valve with said carburetor at a position upstream of said throttle valve when said valve is in the closed condition;

a vacuum advancer connected to a distributor, said vacuum advancer comprising a casing joined at one end to said distributor body, a longitudinally movable advance shaft extending from said distributor body into said casing, said advance shaft being sealingly connected at a position spaced from its outer end to a first diaphragm which extends across said casing, the outer end portion of said advance shaft passing slidably through a second diaphragm which extends across said casing and is spaced from said first diaphragm and defines a first chamber at the end of said casing remote from said distributor, said advance shaft having an enlargement on the side of said second diaphragm remove from said first diaphragm, which enlargement provides an abutment with said second diaphragm, a cup member sealed to said second diaphragm enclosing said enlargement and allowing displacement of said enlargement away from said second diaphragm, a first spring acting on said second diaphragm so as to urge it towards said distributor, a second spring located between said first and second diaphragms so as to urge said second diaphragm towards abutment with said enlargement on said advance shaft, a bellows member sealingly connecting said first diaphragm with said casing so as to define a second chamber in said casing between said bellows member and said first diaphragm, and a vent hole in said casing between said bellows member and said second diaphragm;

a second pipe connecting said first chamber of said vacuum advancer with said carburetor at a position which is always effectively downstream of said throttle valve;

a branch pipe connecting said first pipe with said second chamber in said vacuum advancer, and; a vacuum transmitting valve device in said branch pipe, comprising a hollow valve body having first and second ports communicating with said branch pipe on said carburetor side and vacuum advancer side, respectively, a partition extending across said valve body between said ports, said partition having a restricted orifice which allows restricted transmission of a vacuum from said first port to said second port and a check valve which is arranged so as to open and by-pass said restricted orifice when the gas pressure at said first port is greater than the gas pressure at said second port;

said engine being arranged so that when said throttle valve is opened said first pipe is exposed to the vacuum in said carburetor, which actuates said valve in said recirculation conduit to provide exhaust gas recirculation to said intake manifold, the vacuum in said first pipe being transmitted at a restricted rate controlled by said restricted orifice to said second chamber in said vacuum advancer, whereby the displacement of said first diaphragm against the action of said second spring, and hence the vacuum advance of the ignition timing, is delayed.

* * * * *